US005462075A

United States Patent [19]

Persson

[11] Patent Number: 5,462,075

[45] Date of Patent: Oct. 31, 1995

[54] METHOD AND DEVICE FOR CONTROLLING A FLOW OF FLUID

[76] Inventor: Mats Persson, Kremlevägen 7, S-374 40 Karlshamn, Sweden

[21] Appl. No.: 244,546

[22] PCT Filed: Dec. 7, 1992

[86] PCT No.: PCT/SE92/00843

§ 371 Date: Jun. 3, 1994

§ 102(e) Date: Jun. 3, 1994

[87] PCT Pub. No.: WO93/11313

PCT Pub. Date: Jun. 10, 1993

[51] Int. Cl.[6] ..... F16K 31/24; F16K 33/00

[52] U.S. Cl. ..... 137/2; 137/112; 137/426; 137/438; 137/448; 137/616; 405/39; 405/96

[58] Field of Search ..... 137/395, 398, 137/409, 426, 438, 448, 577, 578, 579, 615, 616, 2; 210/123, 128; 405/39, 96; 222/508, 527, 528, 535, 536, 537

[56] References Cited

U.S. PATENT DOCUMENTS

| | | | |
|---|---|---|---|
| 922,142 | 5/1909 | Hogg | 137/448 |
| 1,108,090 | 8/1914 | Barieau | 137/578 |
| 1,205,199 | 11/1916 | Healy | 137/448 |
| 1,354,879 | 10/1920 | Boland | 137/448 |
| 1,612,195 | 12/1926 | Kirchhan et al. | 137/448 |
| 1,861,397 | 5/1932 | Khun | 137/448 |
| 1,864,443 | 6/1932 | Khun | 137/448 |
| 2,928,410 | 3/1960 | Vecchio | 137/448 |
| 3,181,558 | 5/1965 | Straub | 137/438 |
| 3,916,945 | 11/1975 | Bennett | 137/448 |
| 3,974,654 | 8/1976 | Mirto, Jr. | 137/448 |
| 4,091,624 | 5/1978 | Steinke | 405/96 |
| 4,151,859 | 5/1979 | Jakobi | 137/390 |
| 4,225,434 | 9/1980 | Ernst et al. | 137/397 |
| 4,324,506 | 4/1982 | Steinke | 405/96 |
| 5,123,444 | 6/1992 | Persson et al. | 137/578 |

*Primary Examiner*—George L. Walton
*Attorney, Agent, or Firm*—Joseph C. Mason, Jr.; Ronald E. Smith

[57] ABSTRACT

The method relates to a method and a device for controlling the flow of a liquid. In a well (10) having at least one inlet (11) and one outlet (12) the areas of said inlet (11) is adjusted in dependence on the liquid level in said well (10) by a floating body (13) controlled by said level. Said well is provided with an inlet tube (15) ended by said inlet (11), and at least one outlet (12), a floating body (13) arranged movable in a vertical direction in said well (10), and a slide (14) arranged in said well (10) in front of said outlet (12), said inlet tube (15) and said slide (14) being movable in relation to each other in dependence of a movement of said floating body (13) so as to close adjustably by said slide said inlet (11) of said inlet tube (15).

14 Claims, 7 Drawing Sheets

METHOD AND DEVICE FOR CONTROLLING A FLOW OF FLUID

The sewage disposal system in practically all populated areas can functionally be regarded as combined systems, i.e. surface water in the form of for example rain and waste water is transported in the same pipe. Thus the flow in the pipes and the sewage system can markedly increase and exceed the capacity of the sewage system or the sewage treatment plant in case of for example heavy rain. Water has then to be diverted without actual sewage treatment, i.e. being overflowed.

Since an actual control of the flow in the sewage pipes does not exist the overflow occurs without control and wastewater may reach small waters which can be very sensitive to this discharge. A considerable increase in flow in the form of shock load may also cause large problems at sewage plants. The sedimentation and the nitrogen purification are for example affected by disturbances during heavy sludge escape which takes place if the flow is too large.

By controlling the flow by means of devices for flow control at suitable points in the sewage system in order to vary the flow between zero flow and the full capacity of the pipes the flow can be adjusted or directed in a controlled way to for example a depot. Then overloading in both sewage systems and sewage treatment plants can be avoided and very large environmental and economical effects and advantages can be achieved.

In order to avoid large flows in surface water pipes, for example after a cloud burst, devices have previously been suggested which comprise a well or a tank in which some kind of suction siphon is disposed. Since the flow through the suction siphon is limited a control of the outgoing flow from the well or the tank is effected. Such a process and such a device is shown and described in SE-B 370 430. Similar devices which make use of whirl chambers have also previously been used for flow control. It is also possible to mechanically control all orifices or spillways manually or by means of a engine. An exactly controlled flow from devices which work in this way with pipe or orifice openings or by means of spillway is achieved by varying the area of the orifice or the height of the spillway dependent on the pressure head. This is, however, complicated and requires complicated control devices. The outflow of whirl chambers is also controlled by the static pressure head and when the pressure head is varying it is not possible to keep the outflow constant.

One purpose of the present invention is to achieve a method and a device for flow control, the flow control being controlled independent of the pressure head in the liquid supplying tubes. Flow control should take place automatically in dependence on the liquid level without any help from engines or the like.

This purpose is achieved by the invention having obtained the characterizing features of claim 1 and 3, respectively.

Further advantages are achieved with further developments of the invention, which are defined in the independent claims.

Figure 1:
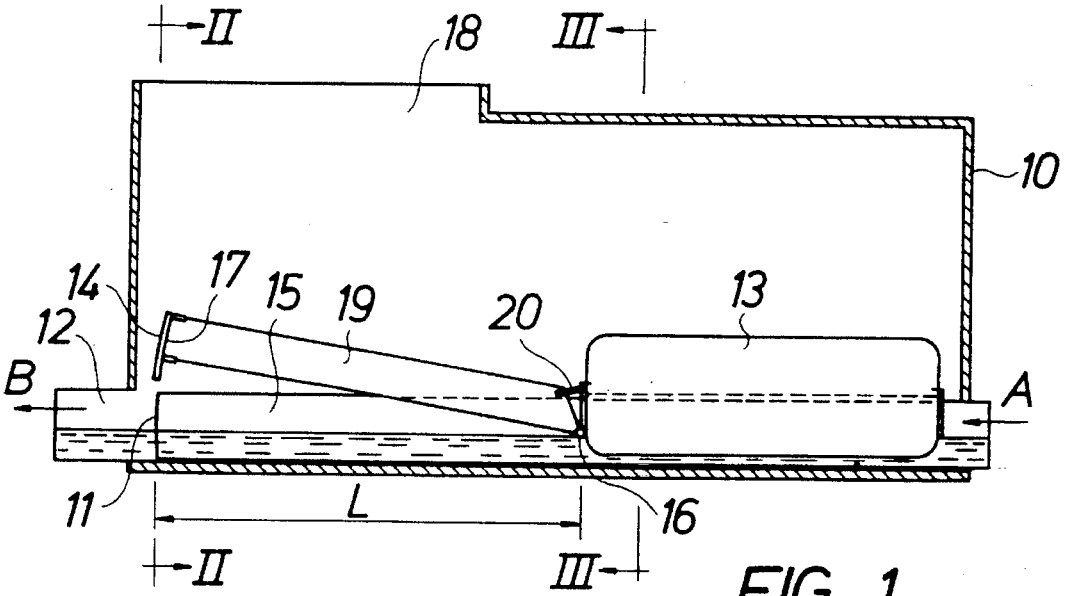
Figure 2:
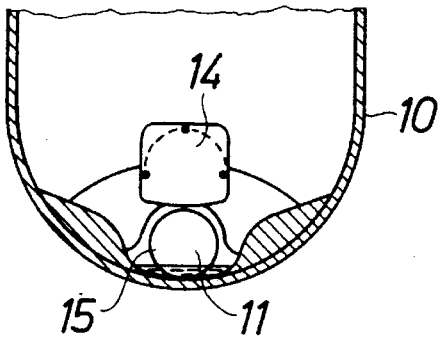
Figure 3:
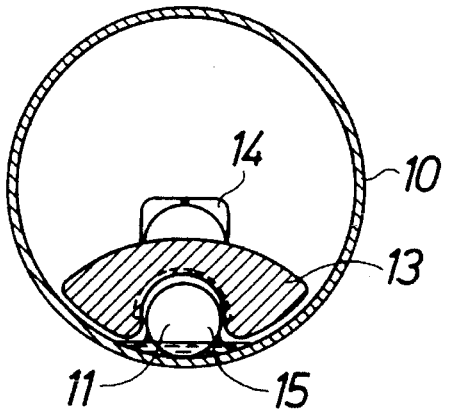
Figure 4:
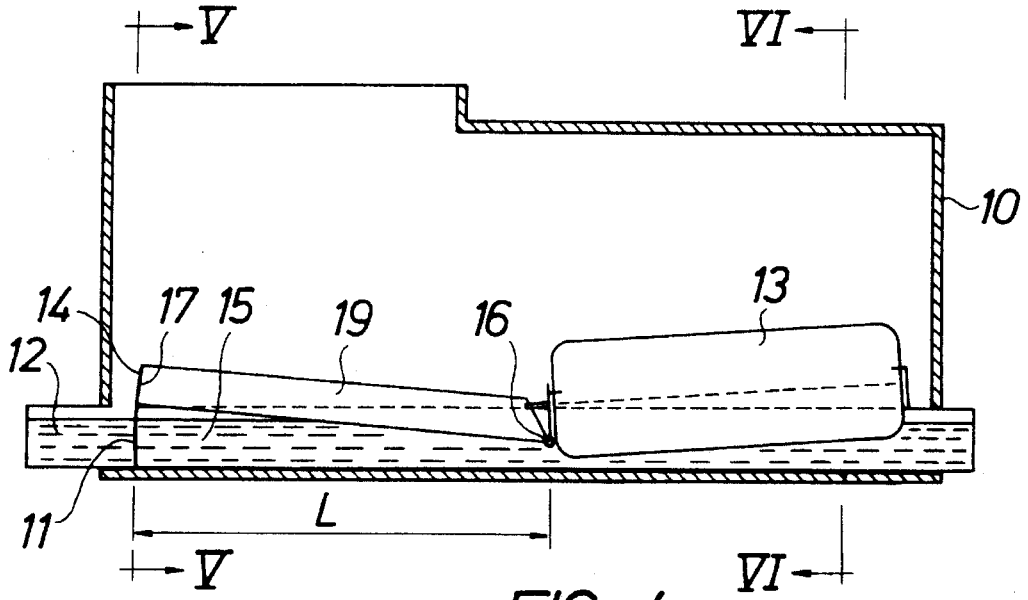
Figure 5:
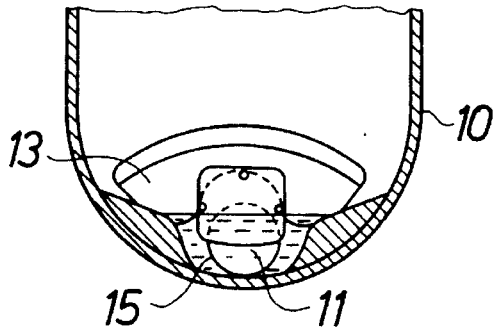
Figure 6:
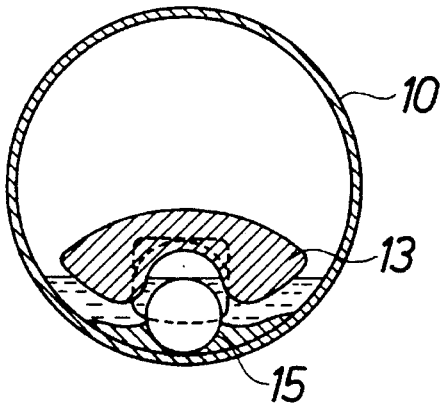
Figure 7:
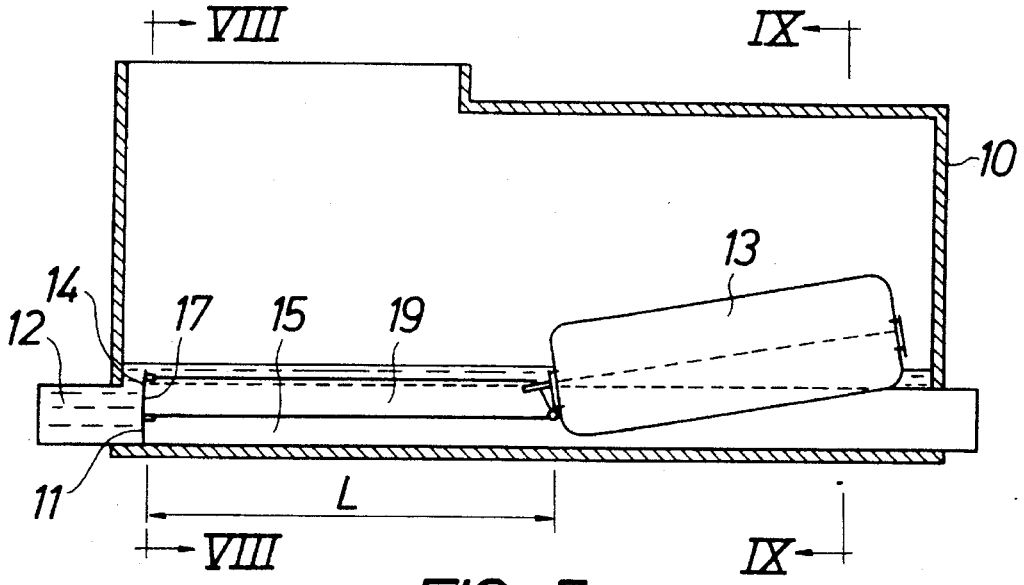
Figure 8:
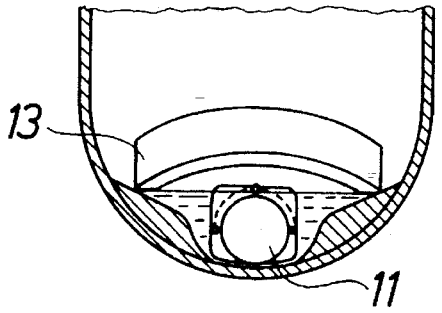
Figure 9:
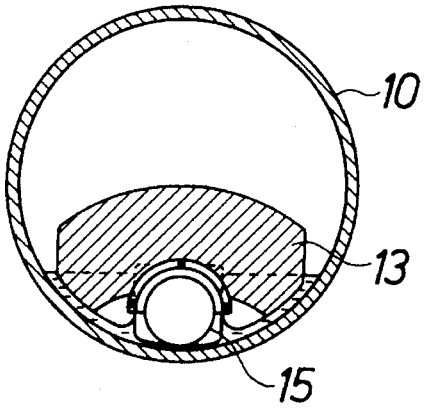
Figure 10:
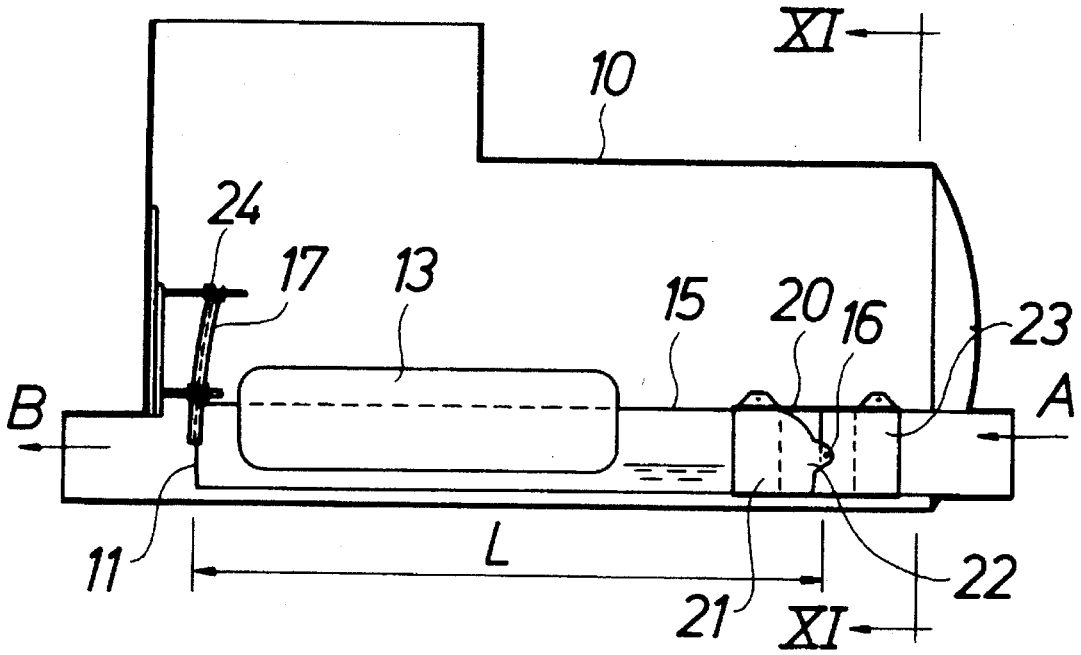
Figure 11:
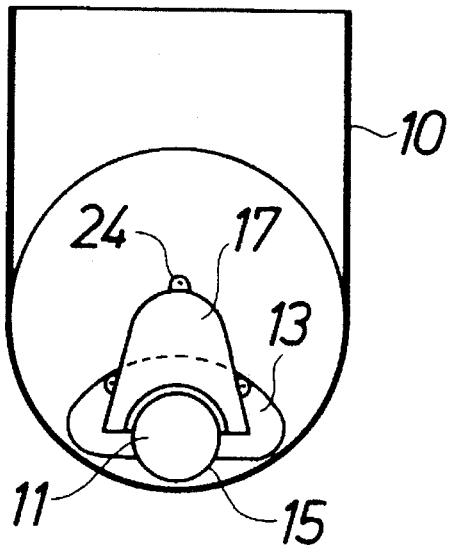
Figure 12:
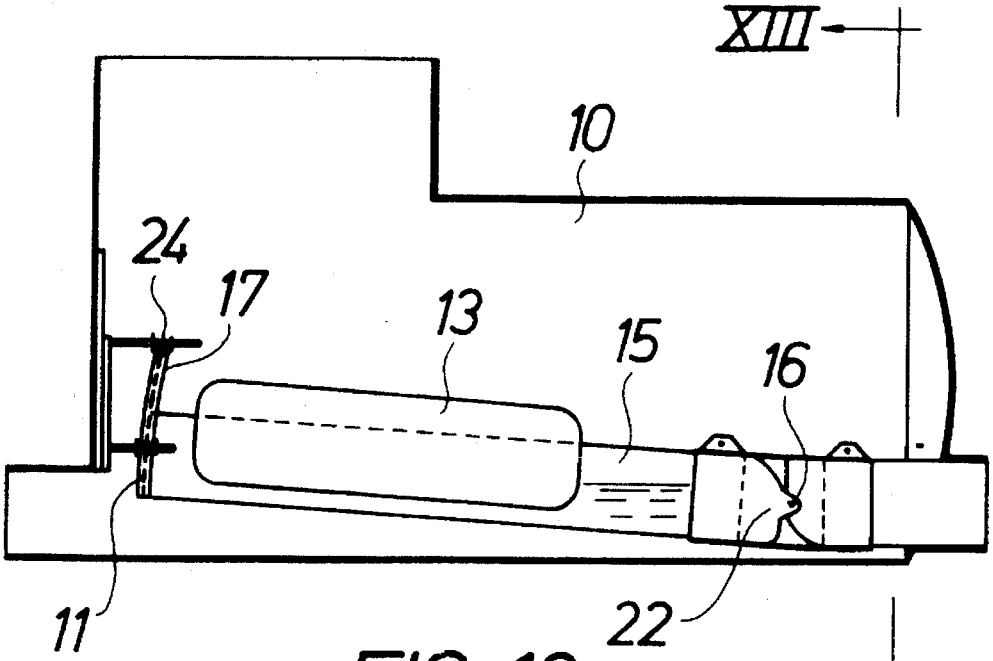
Figure 13:
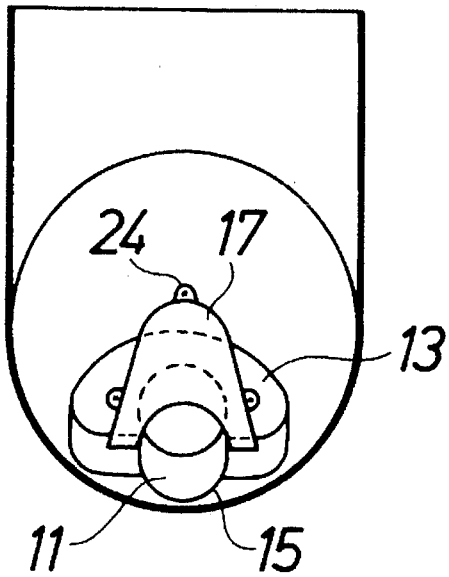
Figure 14:
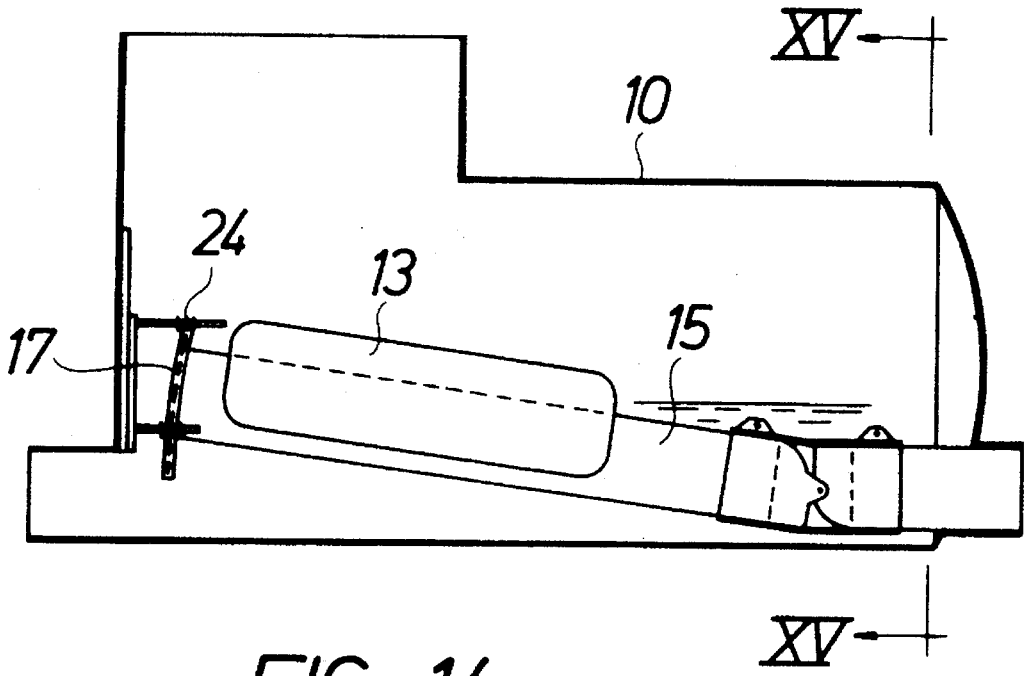
Figure 15:
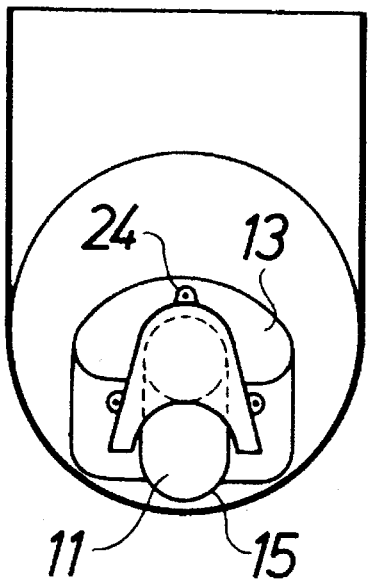
Figure 16:
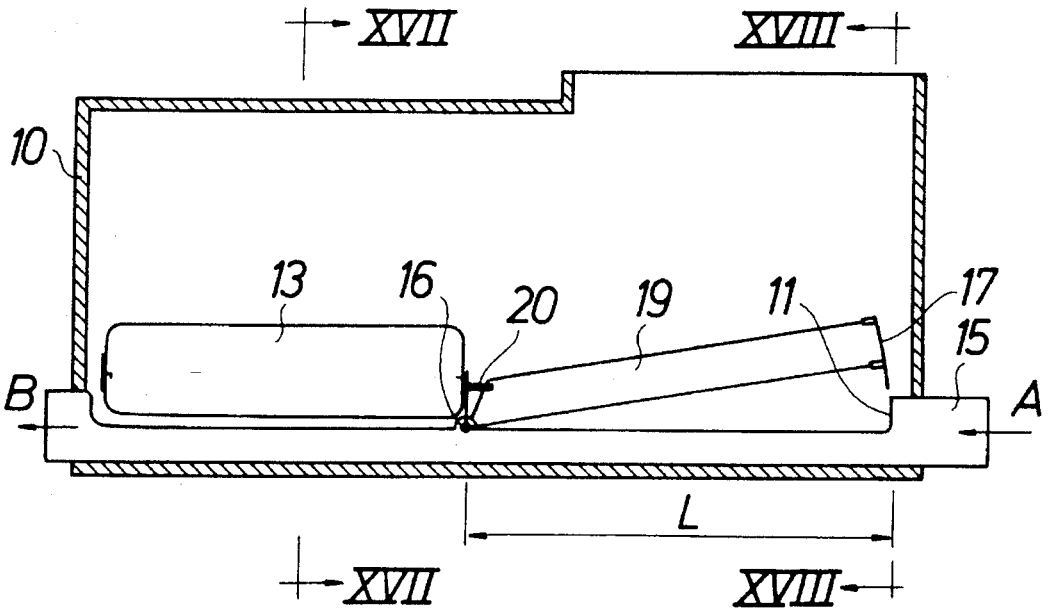
Figure 17:
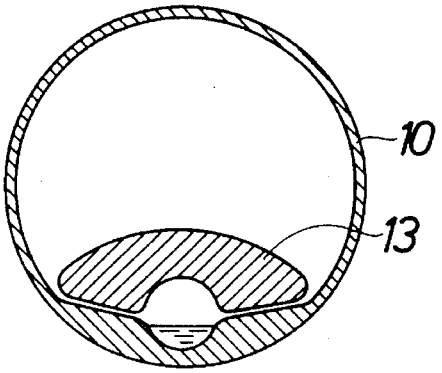
Figure 18:
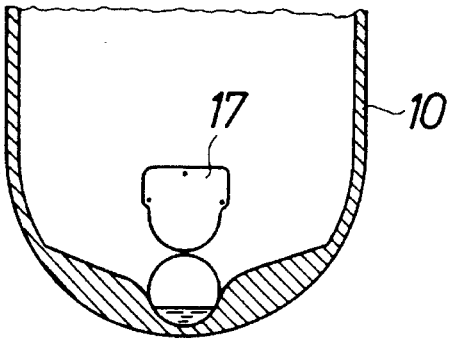

The inventions will now be further described by means of embodiments, reference being made to the accompanying drawings in which FIG. 1 is a side view partly in cross section of the device according to the invention, FIG. 2 is a cross sectional view along the line II—II in FIG. 1, FIG. 3 is a cross sectional view along the line III—III in FIG. 1, FIG. 4 is a side view partly in section of the device according to the invention at a slightly raised water level in relation to FIG. 1–3, FIG. 5 is a cross sectional view along the line V—V in FIG. 4, FIG. 6 is a cross sectional view along the line VI—VI. in FIG. 4, FIG. 7 is a side view partly in section of the device according to the invention with maximal raised water level, FIG. 8 is a cross sectional view along the line VIII—VIII in FIG. 7, FIG. 9 is a cross sectional view along the line IX—IX in FIG. 7, FIG. 10 is a simplified side view of an alternative embodiment according to the invention at low water level, FIG. 11 is a simplified cross sectional view along the line XI—XI in FIG. 10, FIG. 12 is a simplified side view partly in section according to FIG. 10 at a slightly raised water level, FIG. 13 is a simplified cross sectional view along the line XIII—XIII in FIG. 12, FIG. 14 is a simplified side view partly in section of the device according to FIG. 10 at maximal raised water level, FIG. 15 is a simplified cross sectional view along the line XV—XV in FIG. 14, FIG. 16 is a side view partly in section of an additional embodiment of the device according to the invention, FIG. 17 is a cross sectional view along the line XVII—XVII in FIG. 16, and FIG. 18 is a cross sectional view along the line XVIII—XVIII in FIG. 16.

As shown in FIG. 1, the device according to the invention comprises a well 10. The well 10 is cylindrical and arranged lying and comprises an orifice 18 made in the envelope surface of the cylinder, which enables occular examination and control of the device positioned in the well.

An inlet tube 15 is extending through substantially all the length of the well. The inlet tube has an inlet 11 which in the embodiment shown in FIG. 1 is disposed close to an outlet 12 of the well and at the bottom of the well. An elongated floating body 13 is arranged above the inlet tube 15. The floating body has an inside recess, the shape of which essentially corresponds to the shape of the inlet tube so that the inlet tube 15 is partly received in the recess. The bottom surface of the floating body is curved for adjustment against the internal cylindrical shape of the well, as is best shown in FIG. 3. A slide 14 is connected to the floating body 13 through an elongated arched arm 19 so that an obtuse angle is formed between the longitudinal direction of the floating body 13 the longitudinal direction of the arm 19. The angle is adjustable by means of a screw 20. The floating body 13 and the arm 19 are jointly pivotable in a vertical plane in the longitudinal direction of the well 10 around a pivoting axis 16 arranged in the connecting point between the arm 19 and the floating body 13. The slide 14 is a substantially rectangular bent plate, the lower side of which is curved with the same radius as the bottom of the well 10 and the concave side of which is faced towards the pivoting axis 16. The inlet 11 of the inlet tube 15 is constructed with the corresponding shape so that the slide 14 lies close to the inlet 11 during the pivoting movement of the arm 19 around the pivoting axis 16. The radius of the concave surface 17 and of the inlet 11 corresponds to the distance between the pivoting axis 16 and the central point of the inlet 11. The pivoting axis 16 is arranged on the central line of the inlet tube 15. In this embodiment the water in the well flows in the direction of the arrow A and out of the well in the direction of the arrow B. If the inlet tube 15 is arranged above the bottom of the well 10 the shape of the slide 17 can be chosen more independent. By making the concave surface 17 as a circular sector with its radius corresponding to the distance between the pivoting axis 16 and the central point of the inlet 11 an increased pressure in the inlet tube is secured, which results in a creation of a radially directed force against the slide 14 so that the slide 14 is not pivoted. The arm 19 can also be made of several, for example three, tubes or bars and instead of being curved it can be made as an angle iron or the like.

As is evident from FIG. 2 and 3, the water level of the well 10 is so low that the floating body rests against the bottom surface of the well 10 and the total area of the inlet 11 of the inlet tube is available for influx of liquid. By adjusting the screw 20 the obtuse angle between the floating body 13 and the arm 19 can be adjusted so that the characteristics of the device according to the invention are obtained.

FIGS. 4–6 show a well according to FIGS. 1–3 with an increased water level compared with the previous figures. As is especially evident from FIG. 6 the water level is raised, the floating body 13 being lifted up from its earlier state of rest against the bottom of the well. Since the floating body 13 is pivoted around the pivoting axis 16 the lifting of the floating body 13 takes place in a pivoting movement around the axis 16. Then the arm 19 will follow the pivoting movement in order to move the slide 17 downwards over the inlet 11 of the inlet tube. As is evident of FIG. 5, about half the area of the inlet 11 of the inlet tube is covered by the slide 14. By the decrease of the area of the inlet opening 11 the flow into the well is also decreased in a predetermined way.

At a further raised water level in the well 10, which is shown in FIGS. 7–9, the floating body 13 has been lifted so high that the arm 19 has been pivoted to its lowest position, in which the slide 14 completely covers the inlet 11 of the inlet tube 15. Thereby further influx of liquid into the well 10 is prevented until the water level again is lowered to a lower level. By the method and device according to the invention it is guaranteed that the flow of the well never exceeds the present capacity downstream the well and that an increasing pressure line upstream the well 10 is not transferred to constructions downstream the well 10.

FIGS. 10 and 11 show an alternative embodiment according to which a terminating portion of the inlet tube 15 is connected to the remaining portion of the inlet tube 15 by an elastic casing 20. A ring element 21, which is transformed into a clamp 22, surrounds one end of the terminating porting of the inlet tube 15. The clamp 22 is by pivoting axes 16 connected with a corresponding ring 23 of the remaining portion of the inlet tube 15. The floating body 13 is constructed with substantially the same shape as in the earlier described embodiment according to FIGS. 1–9 and is disposed on the terminating part of the inlet tube 15, the inlet or opening 11 of which is shaped in the same way as in the earlier described embodiment. In the embodiment shown in FIGS. 10 and 11 the slide 17 is securedly arranged in relation to the terminating portion of the inlet tube 15. The slide 17 is adjustable by adjustment screws 24 and is constructed with a concave surface 17 facing the terminating portion of the inlet tube 15. Also in this embodiment the radius of the concave surface 17 and the inlet 11 of the inlet tube is equal to the distance between the pivoting axes 16 and the central point of the inlet 11, and the pivot axes 16 are arranged in the horizontal line of the inlet tube 15. The casing 23 is made of rubber or other such elastic material which can endure the present environment for the application in question. The clamp 22 contributes to the guiding of the pivoting movement of the terminating part of the inlet tube 15 so that the pivoting movement will substantially take place in a vertical plane.

FIGS. 12 and 13 show the embodiment of FIGS. 10 and 11 with a somewhat raised water level, the terminating portion of the inlet tube 15 is pivoted upwards around the pivoting axes 16 by the lifting of the floating body 13. Since the floating body 13 is fixedly connected with the inlet tube 15 it will also be pivoted upwards, its inlet 11 being partly pushed over the fixed slide 24. Thereby the inlet area is reduced so that the influx of liquid to the well 10 is reduced.

FIGS. 14 and 15 refer to the same embodiment as FIGS. 10–13 with a maximal height of the water level in the well 10. Then the water level is so high that the floating body 13 and thus the inlet tube 15 are pivoted upwards to such a level that the inlet 11 of the inlet tube is completely covered by the slide 24. Additional liquid is then prevented from flowing into the well 10.

A third embodiment of the device according to the invention is shown in FIGS. 16–18. In this embodiment the inlet tube is made so as to completely extend through the well 10 in the longitudinal direction thereof. However, at the top the inlet tube 15 is about half way cut-off in its extension length of the well 10. The slide 17 is secured in an arm 19 which is pivotable around a pivoting axis 16. The floating body 13 is connected to the arm 19 via an adjustment screw 20 while forming an obtuse angle between the longitudal direction of the floating body 13 and the longitudal direction of the arm 19. When the floating body 13 is pivoted upwards by the raising water level in the well 10 the arm 19 will be pivoted downwards to a corresponding extent, the slide 17 gradually closing the inlet 11 of the inlet tube 15. FIGS. 17 and 18 are in principle cross sectional views of the embodiment shown in FIG. 16.

In an embodiment not shown the shearing of the inlet tube only extends over the length of the floating body and only a slit is cut out in the inlet tube 15 for receiving the slide 17. Instead of cutting off the inlet tube 15 it is also possible to make perforations in the inlet tube for letting in liquid into the well when the outflow is too low and the pressure line is increasing so that the floating body is raised.

Within the scope of the invention as it is defined in following claims are also alternative combinations of a fixed/movable slide and a fixed/movable inlet tube. It is for example possible to arrange the floating body 13 for a upward and downward movement while a movable slide is conveyed. The floating body 13 can also have another shape and for example extend only over a small portion of the inlet tube. Moreover, the floating body 13 can be furnished with means for adjusting its mass in order to accommodate the lifting capacity thereof. In an embodiment not shown a floating body 13 is provided with a cavity which is filled with liquid of such a volume that the desired properties are obtained. It is also suitable that the slide 17 is provided with adjusting means in order to achieve the desired sealing between slide and inlet tube. The shape of the slide can also be varied depending on the application and the desired properties of the device. As is for example evident from FIG. 11, the plane slide 17 can be constructed with a semicircular recess with substantially the same diameter as the inlet tube 15. In the embodiment according to FIG. 18 the movable slide 17 is constructed with a terminating partly circular shaped section with the same diameter as the inlet tube 15, which is lowered into the cut-off inlet tube 15 as the water level in the well 10 is raised.

This invention is clearly new and useful. Moreover, it was not obvious to those of ordinary skill in this art at the time it was made, in view of the prior art considered as a whole.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

I claim:

1. A method for controlling liquid flow, comprising the steps of:

providing a well having a well inlet and a well outlet disposed in opposite ends of said well;

positioning an inlet tube within said well, said inlet tube having a first end extending through said well inlet and having a second end disposed in aligned but spaced apart relation to said well outlet;

positioning a floating body within said well in overlying relation to a first preselected length of said inlet tube;

pivotally connecting a leading end of said floating body to a pivot point within said well so that said floating body pivots about said pivot point as a water level rises and falls within said well;

connecting a trailing end of an elongate arm to said pivot point at a predetermined angle relative to said floating body so that said elongate arm pivots about said pivot point as said water level rises and falls within said well, said elongate arm overlying and extending along a second preselected length of said inlet tube;

attaching an imperforate slide to a distal free end of said arm;

selecting said first and second preselected lengths of said floating body and said elongate arm so that said imperforate slide is disposed above said second end of said inlet tube;

whereby as water rises within said well, said floating body pivots about said pivot point, thereby causing said arm to pivot about said pivot point, thereby lowering said imperforate slide into covering relation to said second end of said inlet tube when the water level is rising within said well and raising said slide out of covering relation to said second inlet tube when the water level is falling within said well.

2. The method of claim 1, further comprising the steps of:

forming said elongate arm so that it conforms to the shape of an upper surface of said inlet tube so that said elongate arm overlies said upper surface of said inlet tube when said elongate arm is fully pivoted due to said floating body reaching a position of maximum height within said well.

3. The method of claim 1, further comprising the step of:

providing adjustment means for adjusting the angular relation between said floating body and said elongate arm so that as the angle therebetween is increased, said imperforate slide restricts flow out of said second end of said inlet tube at lower levels of water within said well, and as the angle therebetween is decreased, said imperforate slide restricts water flow out of said second end of said inlet tube at higher levels of water within said well.

4. The method of claim 3, wherein the step of providing an adjustment means includes the step of interconnecting said elongate arm and said floating body with a screw that is disposed in spaced relation to said pivot point so that turning said screw changes the angular relation between said elongate arm and said floating body.

5. The method of claim 1, further comprising the steps of:

providing a curvature having a predetermined radius of curvature in said second end of said inlet tube;

providing the same curvature in said imperforate slide;

said predetermined radius of curvature corresponding to a distance between said pivot point and said imperforate slide;

whereby water impacting against said imperforate slide is reflected therefrom in a radial direction determined by said radius of curvature so that said water does not change the position of said imperforate slide and said elongate arm to which said slide is attached.

6. The method of claim 1, further comprising the step of:

providing a recess on an underside of said floating body so that said first end of said inlet tube is substantially fully received within said recess when said well is empty.

7. The method of claim 6, further comprising the step of:

providing an underside of said floating body to conform to the configuration of the well so that said underside of said floating body contacts said well when said well is empty.

8. A method for controlling liquid flow, comprising the steps of:

providing a well having a well inlet and a well outlet disposed in opposite ends of said well;

positioning an inlet tube within said well, said inlet tube having a first end extending through said well inlet and having a second end disposed in aligned but spaced apart relation to said well outlet;

providing a pivotal joint in said inlet tube so that said inlet tube has a first part having a first proselected length and a second part having a second preselected length, said first and second Darts of said inlet tube being jointed to one another, said first part being immovably mounted and said second part being free to pivot with respect to said first part;

positioning a floating body within said well in overlying relation to said second part of said inlet tube;

attaching said floating body to said second part of said inlet tube so that said second part of said inlet tube pivots with respect to said first part of said inlet tube as a water level rises and falls within said well;

mounting an imperforate slide within said well in upwardly spaced relation to said well outlet;

preselecting said first and second preselected lengths of said first and second parts so that a distal free end of said second part of said inlet tube is disposed below said imperforate slide;

whereby as a water level rises within said well said floating body and hence said second part of said inlet tube pivot about said pivot point so that said distal free end of aid second part of said inlet tube rises, thereby bringing said distal free end of said second part of said inlet tube into closing relation with said imperforate slide, thereby restricting flow of water through said inlet tube; and whereby as said water level falls within said well, said floating body and hence said second part of said inlet tube pivot about said pivot point so that said distal free end of said second part of said inlet tube falls, thereby taking said distal free end of said second part of said inlet tube out of closing relation with said imperforate slide, thereby increasing flow of water through said inlet tube.

9. The method of claim 8, further comprising the step of:

adjustably mounting said imperforate slide on said well so that restriction of water flow through said inlet tube commences when a relatively low level of water is in said well when said imperforate slide is mounted in a lower position, and so that said restriction commences when a relatively high level of water is in said well when said imperforate slide is mounted in an upper position.

10. The method of claim 8, further comprising the step of:

interconnecting said first and second parts of said inlet tube with an elastic socket.

11. The method of claim 10, further comprising the steps of:

providing a first ring that surrounds a leading end of said first part of said inlet tube in overlying relation to said elastic socket;

providing a second ring that surrounds a trailing end of said second part of said inlet tube in overlying relation to said elastic socket; and pivotally engaging said first and second rings to one another by providing a yoke means on a preselected one of said rings that pivotally engages its opposing ring.

12. A method for controlling liquid flow, comprising the steps of:

providing a well having a well inlet and a well outlet disposed in opposite ends of said well;

positioning an inlet tube within said well, said inlet tube having a first end extending through said well inlet and having a second end extending through said well outlet;

providing a cut out top part of said inlet tube along a substantial part of its extent so that said cut out too part has a leading end near a leading end of said inlet tube and so that said cut out top part has a trailing end near a trailing end of said inlet tube;

providing a pivot point in said inlet tube at a preselected position along the extent thereof, said pivot point dividing said inlet tube into a first part having a first length and a second part having a second length;

positioning a floating body having a first preselected length, within said well in overlying relation to said second part of said inlet tube;

pivotally connecting a trailing end of said floating body to said pivot point so that said floating body pivots about said pivot point as a water level rises and falls within said well;

positioning an elongate arm, having a second preselected length, within said well in overlying relation to said first part of said inlet tube;

connecting a leading end of said elongate arm to said pivot point at a predetermined angle relative to said floating body so that said elongate arm pivots about said pivot point as said water level rises and falls within said well;

attaching an imperforate slide to a distal free end of said elongate arm;

selecting said first and second lengths of said floating body and said elongate arm so that said imperforate slide is disposed above said leading end of said cut out part of said inlet tube;

whereby as water rises within said well, said floating body pivots about said pivot point, thereby causing said elongate arm to pivot about said pivot point, thereby lowering said imperforate slide into closing relation to said inlet tube at the leading end of said cut out part of said inlet tube and raising said imperforate slide out of closing relation to said inlet tube when the water level is falling within said well.

13. The method of claim 12, further comprising the step of:

providing adjustment means for adjusting the angular relation between said floating body and said elongate arm so that as the angle therebetween is increased, said imperforate slide restricts flow through said leading end of said inlet tube at lower levels of water within said well, and as the angle therebetween is decreased, said imperforate slide restricts water flow through said leading end of said inlet tube at higher levels of water within said well.

14. The method of claim 13, wherein the step of providing an adjustment means includes the step of interconnecting said elongate arm and said floating body with a screw that is disposed in spaced relation to said pivot point so that turning said screw changes the angular relation between said elongate arm and said floating body.

* * * * *